US006258224B1

(12) United States Patent
Mirtchi

(10) Patent No.: US 6,258,224 B1
(45) Date of Patent: Jul. 10, 2001

(54) MULTI-LAYER CATHODE STRUCTURES

(75) Inventor: Amir A. Mirtchi, Jonquiere (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/440,759

(22) Filed: Nov. 16, 1999

Related U.S. Application Data

(60) Provisional application No. 60/112,458, filed on Dec. 16, 1998.

(51) Int. Cl.[7] ..... B01D 59/50

(52) U.S. Cl. ..... 204/247.3; 204/290.01; 204/290.03; 204/290.12; 204/290.13; 204/290.15; 264/105; 264/119; 264/241; 264/293

(58) Field of Search ..... 264/104, 105, 264/119, 136, 146, 162, 171, 177.17, 241, 243, 293; 204/243.1, 247.3, 290.01, 290.03, 290.12, 290.13, 290.15

(56) References Cited

U.S. PATENT DOCUMENTS 5,961,811 10/1999 Keller ..... 205/386

6,001,236 * 12/1999 de Nora et al. ..... 204/243.1

* cited by examiner

*Primary Examiner*—Bruce F. Bell
(74) *Attorney, Agent, or Firm*—Cooper & Dunham LLP

(57) ABSTRACT

A process of producing multi-layer cathode structures. In one aspect, the process comprises providing a carbonaceous cathode substrate, and forming at least one layer of a metal boride-containing composite refractory material over the substrate, wherein the surface of the carbonaceous substrate to be coated is roughened prior to the formation of the layer overlying the said surface. The roughening of the surfaces reduces the tendency of the layers to separate in high temperature operating conditions. In another aspect, the process comprises providing a carbonaceous cathode substrate, and forming at least two coating layers of a metal boride-containing composite refractory material successively over the substrate, wherein the content of metal boride in the coating layers increases progressively as the distance of the layer from the substrate increases. By graduating the content of metal boride among several coating layers, the effect of differences in thermal expansion rates between carbon and metal boride are attenuated. The metal of the metal boride is selected from the group consisting of titanium, zirconium, vanadium, hafnium, niobium, tantalum, chromium and molybdenum.

24 Claims, 1 Drawing Sheet

MULTI-LAYER CATHODE STRUCTURES

This application claims the benefit of U.S. Provisional Application No. 60/112,458, filed Dec. 16, 1998.

BACKGROUND OF THE INVENTION

I. Field of the Invention

This invention relates to cathodes used in electrolysis cells, particularly in the cells used for the production of aluminum metal. More particularly, the invention relates to multi-layer cathode structures used in reduction cells of this type.

II. Description of the Prior Art

In metal reduction cells it is usual to line a container with a carbonaceous material, such as anthracite and/or graphite, and to use the carbonaceous layer as a cathode for the cell. A molten electrolyte is held within the container and carbon anodes dip into the molten electrolyte from above. As electrolysis proceeds, molten metal forms a pool above the cathode layer.

The cathode layer, which normally extends along the bottom wall of the cell and possibly up the side walls to a level above the height of the surface of the molten electrolyte, eventually breaks down and the cell has to be taken out of operation for cathode repair or replacement. This is because the surface and joints of the carbonaceous material are attacked and eroded by the molten metal and electrolyte. The erosion/corrosion of the bottom blocks is a particular problem because of movements of the cell contents caused by magneto-hydrodynamic effects (MHD).

Attempts have been made to make cell cathodes more durable by providing the carbonaceous material with a protective lining. The lining must, of course, be electrically-conductive and, to facilitate the operation of self-draining cathode cells, should be wettable by the molten metal.

Lining materials used for this purpose have included refractory composites made of a carbonaceous component and a refractory metal oxide or boride. Because of its desirable erosion resistance and metal wettability, titanium boride ($TiB_2$) is a particularly preferred material for use in such composites, despite its extremely high cost. However, the use of this material causes a problem in that it has a different coefficient of thermal expansion compared to that of carbon. During operation at high temperature in the cell, cracks tend to form at the interface of the coating and the underlying cathode carbon, leading to eventual failure of the cathode structure. Thus, the effective service life of the cell is not prolonged as much as would be desired using multi-layer cathode structures of this kind. In fact, although various kinds of cathode structures have been proposed in the past, usually requiring ceramic tiles of $TiB_2$ adhered to carbon blocks, no such structures are in common use today because the tiles eventually dislodge or crack due to the difference in thermal expansion properties. The same is also true of other composite coating materials, e.g. those containing refractory metals oxides (such as $TiO_2$ and $SiO_2$), silicon, nitrides, etc.

A possible solution to this problem would be to provide cathodes structures made entirely of blocks of the composite materials. However, the high cost of such composites (particularly those based on $TiB_2$), has prevented this as a widespread solution.

An attempt to improve the adhesion of the layers is disclosed in U.S. Pat. No. 5,527,442 to Sekhar et al., issued on Jun. 18, 1996. This patent relates to the coating of refractory materials (including titanium borides) onto substrates made of different materials, particularly carbonaceous materials, for use in aluminum reduction cells. To avoid adhesion problems, the coating material is applied as a micropyretic slurry to the carbonaceous substrate which, when dried, is ignited to produce condensed matter forming a coating adherent to the surface of the substrate and thus protecting it. However, such a process is expensive, has not been adopted on a significant industrial scale and also this material has a short operational life.

There is, therefore, a need for an improved way of forming multi-layer cathodes that are not subject to unacceptable rates of dislodgement or cracking of the protective layers.

SUMMARY OF THE INVENTION

An object of the present invention is to overcome adhesion and cracking problems in multi-layer cathode structures.

Another object of the present invention is to provide a process of producing multi-layer cathode structures having an acceptable operating life in aluminum production cells.

Yet another object of the invention is to provide multi-layer cathodes in which protective outer layers remain firmly adhered to underlying carbonaceous layers during high temperature use in aluminum production cells.

According to one aspect of the invention, there is provided a process of producing multi-layer cathode structures, which comprises providing a carbonaceous cathode substrate, and forming at least one layer of a metal boride-containing composite refractory material over the substrate, wherein the surface of the carbonaceous substrate to be coated is roughened prior to the formation of the layer overlying the said surface.

According to another aspect of the invention there is provided a process of producing multi-layer cathode structures, which comprises providing a carbonaceous cathode substrate, and forming at least two coating layers of a metal boride-containing composite refractory material successively over the substrate, wherein the content of metal boride in the coating layers increases progressively as the distance of the layer from the substrate increases.

DESCRIPTION OF THE PREFERRED EMBODIMENTS

While the preferred metal boride is $TiB_2$, the metal may be selected from the group consisting of titanium, zirconium, vanadium, hafnium, niobium, tantalum, chromium and molybdenum. Thus, where reference is made to $TiB_2$, it will be understood that the titanium may be replaced by any of the other above metals.

The cathode is preferably formed in a mould having closed sides and bottom and an open top. A carbonaceous substrate material preferably having a thick, pasty consistency is placed in the bottom of the mould and the top surface of this substrate is then roughened, e.g. by drawing a rake across the surface. The times of the rake form grooves in the surface of the substrate. At least one layer of a $TiB_2$-containing composite refractory material is placed over the raked substrate and a weight which is the full internal dimension of the mould is placed on top of the cathode material.

The entire mould unit is then vibrated to compress the material into a green cathode shape, which is then prebaked and machined prior to insertion into an electrolysis cell. In addition to compaction, the vibration step also causes some mixing of the material resulting in a mixed area which is actually thicker than the depths of the grooves formed in the substrate.

A typical rake for the above purpose has times spaced about 25 mm apart and lengths of about 75 to 100 mm. A typical commercial cathode has dimensions of about 43 cm high, 49 cm wide and 131 cm long. When more than one layer of $TiB_2$-containing composite is placed on top of the substrate, it is desirable to rake the top surface of each layer before applying a further layer.

It is also preferred that, when more than one coating layer over the substrate is provided, the content of $TiB_2$ in the layers increase with the distance of the layer from the carbonaceous substrate. That is to say, the outermost coating layer should preferably have the highest $TiB_2$ content and the innermost coating layer should preferably have the lowest. The other main component of the $TiB_2$-containing component is a carbonaceous material, usually in the form of anthracite, pitch or tar. The carbonaceous material of the substrate is also usually in the form of anthracite, graphite, pitch or tar.

Most practically, there should preferably be at least 2 coating layers, and the content of the $TiB_2$ should increase from about 10–20% by weight in the innermost layer to about 50 to 90% in the outermost layer. For example, a cathode having three $TiB_2$-containing layers may have a top layer containing 50–90% $TiB_2$ and 50–10% carbon, and intermediate layer containing 20–50% $TiB_2$ and 80–50% carbon and a bottom layer containing 10–20% $TiB_2$ and 90–80% carbon. By graduating the increase of $TiB_2$ across several coating layers, differences of thermal expansion between the outermost coating layer and the inner carbonaceous substrate are extended across the thickness of the cathode structure.

When a single $TiB_2$-containing layer is used, it also preferably contains at least 50% $TiB_2$.

The thickness of the layer as well as the roughening (raking) of the interface between layers are important in avoiding cracking of the cathodes. Thus, if the overall thickness of the layer(s) containing $TiB_2$ is less than about 20% of the total cathode height, cracking may occur whether or not there is roughening of the interface surface. When cracking has occurred, it has also been noted in other parts of the $TiB_2$-containing layer than the interface and at various angles to the interface. When two or more $TiB_2$-containing layers are used, each layer should have a thickness of at least about 10% of the total height of the cathode. The use of multiple layers of varying $TiB_2$ content further aids in preventing cracking of the final cathode.

BRIEF DESCRIPTION OF THE DRAWINGS

FIG. 1 shows a carbonaceous substrate 10 which has been raked to form a series of grooves 11. A $TiB_2$-containing layer 12 has been applied over the raked substrate 10. This is shown prior to vibration and compaction.

FIG. 2 shows a carbonaceous substrate 10 which has been raked to form a series of grooves 11. On top of this have been applied three $TiB_2$-containing layers 12*a*, 12*b* and 12*c* with intermediate grooves 11*a*, 11*b* and 11*c*.

Figure 1:
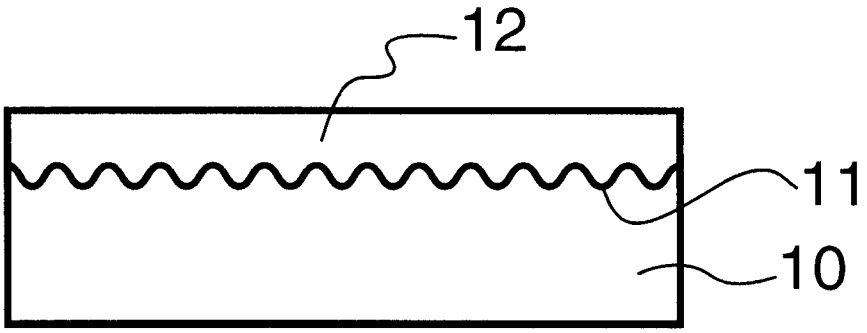
FIG. 1 is a schematic cross-section of a cathode with one $TiB_2$-containing layer.
Figure 2:
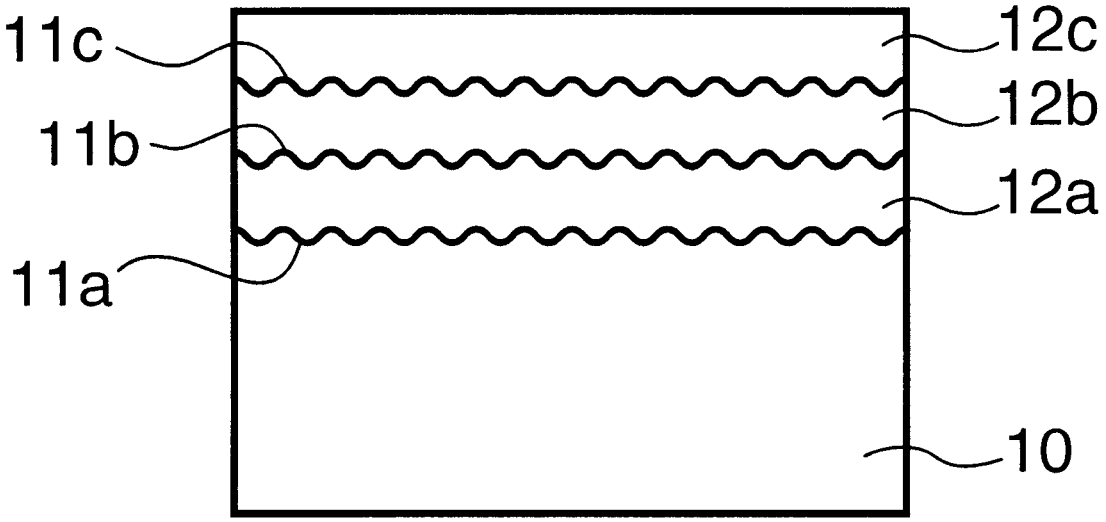
FIG. 2 is a schematic cross-section of a cathode with three $TiB_2$-containing layers.

It will also be understood that the present invention includes within its scope a cathode structure with multiple $TiB_2$-containing layers as shown in FIG. 2 in which the interfaces between the layers have not been raked to form the intermediate grooves 11*a*, 11*b* and 11*c*.

The present invention is illustrated in more detail by reference to the following Examples, which are provided for the purpose of illustration only.

EXAMPLE 1

Tests were conducted in which cathodes were formed having (a) three layers and (b) two layers.

(a) Three-layer Cathode

A substrate comprising 84 wt % anthracite and 16 wt % pitch was mixed at 160° C. and the hot mix was then poured to a depth of about 4 cm into a laboratory mould having dimensions of 10 cm×10 cm×40 cm. The surface of the hot substrate was then raked with a rake having times about 1.2 to 2.5 mm long. A composite comprising 15 wt % $TiB_2$, 68 wt % anthracite and 17 wt % pitch, which had been mixed for about one hour at 160° C., was then added on top of the raked substrate to a thickness of 2.5 cm and the top surface of the added composite was also raked. Next a composite comprising 50 wt % $TiB_2$, 32 wt % anthracite and 18 wt % pitch, which had been mixed for about one hour at 160° C., was added on top of the hot, raked composite layer to a thickness of 2.5 cm. A weight was then placed over the multi-layer cathode and it was vibrated for compaction. It was then baked at 1200° C. for five hours.

(b) Two-layer Cathode

A two-layer cathode was prepared using the same laboratory mould, substrate material and composite as described above. The substrate was formed to a depth of about 8 cm and raked as described above. Then the composite was added on top of the substrate to a thickness of about 2 cm and the cathode assembly was compacted and baked.

A further two-layer cathode was prepared using a plant mould which forms cathode blocks having dimensions 43 cm×49 cm×131 cm. The substrate material described above was poured into the mould to a depth of about 37 cm, after which the surface was raked. Next a single composite layer comprising 50 wt % $TiB_2$, 32 wt % antracite and 18% pitch was added to a thickness of about 6 cm. The cathode assembly was then compacted and baked. These commercial two-layer cathodes with raked interface have been used for 8 months in an industrial electrolysis test and have behaved very satisfactorily during both cell start-up and cell operation.

The above three-layer and two-layer cathodes using the same mould and compositions were also prepared without intermediate raking of the interface surface. No inter-layer cracking was observed in the cathode prepared with intermediate raking. Without the intermediate raking, inter-layer cracking was observed in the two-layer cathode.

EXAMPLE 2

An electrolysis test was conducted using a two-layer cathode prepared in accordance with Example 1 containing 55 wt % $TiB_2$ and 45 wt % carbon (mixture of anthracite and pitch).

Electrolysis conditions:

$Al_2O_3$=6%

$AlF_3$=6%

$CaF_2$=6%

Ratio ($AlF_3$/NaF)=1.25

ACD=3 cm

Bath temperature=970° C.

Cathode current density=1 mp/$cm^2$

The test was conducted for about 1,000 hours. After about 5 hours, an aluminum layer began forming on the composite surface of the cathode. No corrosion or oxidation of the sample was observed at the sample-bath-air interface.

EXAMPLE 3

The procedure of Example 2 was repeated using as cathode the three-layer cathode described in Example 1 was used.

Electrolysis conditions:

$Al_2O_3$=6%

$AlF_3$=6%

$CaF_2$=6%

Ratio ($AlF_3$/NaF)=1.25

ACD=3 cm

Bath temperature=970° C.

Cathode current density=1 amp/$cm^2$

The test was conducted for 100 hours and after a few hours it was observed that an aluminum layer had begun forming on the composite surface of the cathode. No inter-layer cracks were observed.

What is claimed is:

1. A process of producing multi-layer cathode structures, which comprises:

providing a carbonaceous cathode substrate, and forming at least one layer of a metal boride-containing composite refractory material over the substrate, wherein the surface of the carbonaceous substrate to be coated is roughened by drawing a rake across the surface to form grooves therein prior to the formation of the layer overlying the said surface.

2. A process according to claim 1 wherein the metal of the metal boride is selected from the group consisting of titanium, zirconium, vanadium, hafnium, niobium, tantalum, chromium and molybdenum.

3. A process according to claim 2 wherein the metal is $TiB_2$.

4. A process according to claim 3 wherein at least two layers of $TiB_2$-containing composite refractory material are provided over the substrate, the surface of each layer being raked prior to applying a further layer.

5. A process according to claim 4 wherein each $TiB_2$-containing layer has a thickness of at least 10% of the total cathode thickness.

6. A process according to claim 5 wherein the content of $TiB_2$ in the coating layers increases progressively as the distance of the layer from the substrate increases.

7. A process according to claim 3 wherein a single $TiB_2$-containing composite refractory layer is applied over the roughened substrate, said $TiB_2$-containing layer having a thickness of at least 20% of the total cathode thickness.

8. A process according to claim 1 wherein the carbonaceous cathode substrate with the at least one layer of said composite refractory material placed on the roughened surface are compressed and baked.

9. A process of producing multi-layer cathode structures, which comprises:

providing a carbonaceous cathode substrate, and forming at least two coating layers of a metal boride-containing composite refractory material successively over the substrate, wherein the content of metal boride in the coating layers increases progressively as the distance of the layer from the substrate increases.

10. A process according to claim 9 wherein the metal of the metal boride is selected from the group consisting of titanium, zirconium, vanadium, hafnium, niobium, tantalum, chromium and molybdenum.

11. A process according to claim 10 wherein the metal is $TiB_2$.

12. A process according to claim 11 wherein the carbonaceous substrate is formed of anthracite, graphite, pitch, tar or mixtures thereof.

13. A process according to claim 12 wherein each $TiB_2$-containing layer comprises $TiB_2$ mixed with a carbonaceous material selected from the group consisting of anthracite, pitch and tar.

14. A process according to claim 13 wherein each $TiB_2$-containing layer has a thickness of at least 10% of the total cathode thickness.

15. A process according to claim 14 wherein the $TiB_2$-containing layer most remote from the substrate contains 50–90 wt % $TiB_2$.

16. A process according to claim 15 wherein the $TiB_2$-containing layer closest to the substrate contains 10–20 wt % $TiB_2$.

17. A process according to claim 16 wherein an intermediate $TiB_2$-containing layer is provided containing 20–50 wt % $TiB_2$.

18. A process of producing multi-layer cathode structures, which comprises:

providing a carbonaceous cathode substrate, roughening the surface of the substrate, placing at least one layer of a metal boride-containing composite refractory material over the roughened substrate, compressing the carbonaceous cathode substrate and at least one layer of composite refractory material into a green cathode and baking the green cathode.

19. A process according to claim 18 wherein the metal of the metal boride is selected from the group consisting of titanium, zirconium, vanadium, hafnium, niobium, tantalum, chromium and molybdenum.

20. A process according to claim 19 wherein the metal boride is $TiB_2$.

21. A process according to claim 20 wherein at least two layers of $TiB_2$-containing composite refractory material are provided over the substrate, the surface of each layer being roughened prior to applying a further layer.

22. A process according to claim 21 wherein each $TiB_2$-containing layer has a thickness of at least 10% of the total cathode thickness.

23. A process according to claim 22 wherein the content of $TiB_2$ in the coating layer increases progressively as the distance of the layer from the substrate increases.

24. A process according to claim 20 wherein a single $TiB_2$-containing composite refractory layer is applied over the roughened substrate, said $TiB_2$-containing layer having a thickness of at least 20% of the total cathode thickness.

* * * * *